United States Patent [19]

Pálsson

[11] 4,456,136

[45] Jun. 26, 1984

[54] SAFETY CLOSURE

[76] Inventor: Johannes S. Pálsson, Enghave Plads 13, 1670 Copenhagen V, Denmark

[21] Appl. No.: 506,321

[22] Filed: Jun. 21, 1983

[30] Foreign Application Priority Data

Jul. 1, 1982 [DK] Denmark ..... 2961/82

[51] Int. Cl.[3] ..... B65D 55/02

[52] U.S. Cl. ..... 215/216; 215/209; 215/330; 215/254

[58] Field of Search ..... 215/209, 216, 330, 253, 215/254

[56] References Cited

U.S. PATENT DOCUMENTS

| | | | |
|---|---|---|---|
| 3,917,097 | 11/1975 | Uhlig | 215/216 |
| 4,144,983 | 3/1979 | Pauls et al. | 215/216 |
| 4,331,247 | 5/1982 | Mumford | 215/216 |

*Primary Examiner*—George T. Hall
*Attorney, Agent, or Firm*—Holman & Stern

[57] ABSTRACT

A safety closure, preferably for a medicine bottle, has a screw cap (20) or another closure cap which is to be rotated to be applied or removed, and a blocking mechanism in the form of an elastically resilient blocking means (16) on the bottle neck (11) or a collar securely mounted on the neck, and a stop face (26) on the closure cap. The cap has an area (27) of reduced wall thickness which is opposite the blocking means in the closed position and permits the blocking means to be actuated by external pressure on the cap. When the cap is rotated in the direction of removal from the closed position, the stop face encounters the blocking means and prevents additional rotation, unless the blocking means is pressed clear of the stop face by pressure on said area of the closure cap. The blocking means (16) is a string or strip merging at both ends into the bottle neck or collar, but is spaced from the neck or collar at its central portion having a blocking face (17), and this allows the blocking means to retain its tendency to return to the blocking position after actuation, even though the elasticity of the material decreases after many operations.

7 Claims, 3 Drawing Figures

SAFETY CLOSURE

BACKGROUND OF THE INVENTION

1. Field of the Invention

The invention relates to a safety closure for a container which serves as a receptacle for sensitive products, e.g. medicine.

Such safety closures serve to impede the removal of the closure sufficiently for children and others who are ignorant of the dangers presented by the contents of the container to be unable to open the container, which may e.g. be a medicine or pill bottle, without the opening operation becoming so difficult as to cause problems to the qualified user.

2. Description of the Prior Art

A safety closure of the present type is shown in FIGS. 20–24 of U.S. Pat. No. 3,917,097. The safety effect is conditional upon the elastically resilient blocking means being sufficiently elastic to return to the blocking position with certainty after having been pressed inwards against the container neck to cancel the blocking. For reasons of production and price the blocking means should preferably be made integral with the container neck part and thus consist of the same plastics material as that part. However, it has been found that having been used for an extended period of time the known safety closures with plastics blocking means are subject to fatigue, causing the blocking means to gradually lose some of its elasticity with the result that it sometimes remains in an inactive position after impression so that the closure cap can now be removed without prior actuation of the blocking means.

BRIEF SUMMARY OF THE INVENTION

The object of the invention is to improve the safety in the use of safety closures of the present type. This object is achieved in that the safety closure is formed so that the string- or strip-shaped blocking means is secured to the container neck part at both ends which makes it far more likely that the blocking means returns to the blocking position after actuation than a corresponding blocking means which is only secured at one end.

Both the stop face of the closure cap and its elastically resilient part can be provided in a simple manner by forming the closure cap with a recess.

The partial separation of the elastically resilient part from the rest of the closure cap in consequence of the arrangement of the invention provides for easier operation of the resilient part and a clear indication of its position.

It is desirable in many cases that it can be seen on a safety closure whether it has been opened. This wish can be complied with in a simple manner by forming the closure with a stiffening member which, as long as it remains in position, prevents the impression of the thin wall member which is necessary to actuate the blocking means.

The safety closure formed may also be formed so that the blocking means is automatically pressed inwards by cam action between its outwardly and upwardly inclined face and the lower edge of the closure cap when the cap is applied so that the application is not impeded by engagement between the parts.

BRIEF DESCRIPTION OF THE DRAWING

The invention will be explained more fully below with reference to the accompanying drawing wherein.

DETAILED DESCRIPTION

Figure 1:
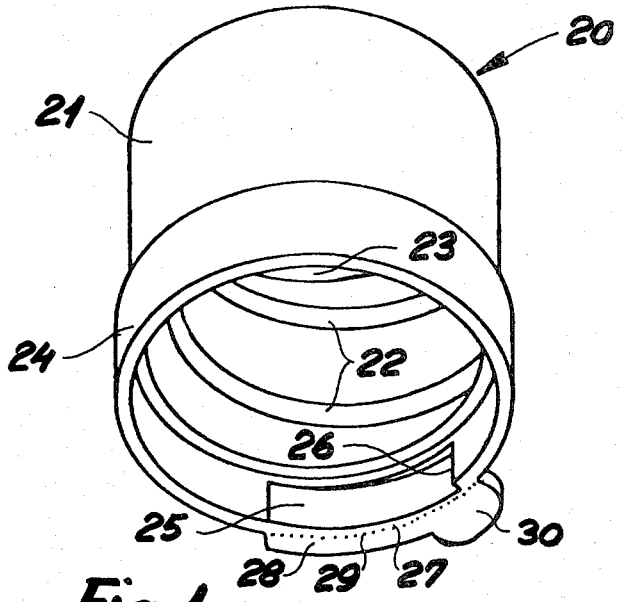
FIG. 1 is an exploded perspective view showing an embodiment of the safety closure of the invention used in connection with a bottle.

In FIG. 1 10 represents the upper part of a bottle, preferably of glass, whose neck 11 has securely attached to it a neck member in the form of a collar 12 of a strong, elastic material, such a polypropylene, polystyrene, nylon or acetate plastics. The collar 12 is formed with external threads 13 and an end flange 14 defining a central opening 15. The collar has also a string-shaped blocking means 16 of rectangular cross-section, which extends along a portion of the lower edge and is secured at the ends, only one of which is shown in the drawing, to the collar or merges into it. The attachment can be effected by gluing or welding. In or adjacent the middle the blocking means 16 is formed with a blocking face 17 disposed substantially in a plane containing the axis of the collar, and the blocking means is spaced from the rest of the collar a distance at either side of the blocking face, and this part of the blocking means is thus elastically resilient. The collar 12 may be made by injection moulding.

A closure cap 20 has a skirt 21, which is formed with internal threads 22, and an end wall 23. The closure cap 20 has moreover at its lower edge a sleeve member 24 which has a somewhat greater diameter than the rest of the closure cap and serves to receive the blocking means 16 on the collar 12. The interior of the sleeve member 24, along a section of its lower edge, is formed with a substantially wedge-shaped recess 25 whose truncated end face 26 forms a stop face which cooperates with the blocking means 16 of the collar 12. The recess 25 defines a thin-walled sleeve area 27, the location of which may be marked on the exterior of the sleeve.

Along the section of the lower edge of the sleeve member 24 disposed opposite the recess 25, the exterior of the sleeve is formed with a sheet-shaped stiffening member 28 disposed substantially at right angles to the axis of the closure cap. A plurality of perforations 29 closely spaced from the exterior of the sleeve member form a weakened line along which the stiffening member may be torn off by gripping a gripping flap 30, which is formed at one end of the stiffening member. The gripping flap 30 extends a distance past the stop face 26.

When the closure cap is screwed onto the collar 12 on the bottle neck 11, the blocking means 16 is pressed inwards against the wall of the collar 12 against its spring action, and the blocking face 17 on the blocking means and the stop face 26 on the cap 20 are so located with respect to each other and the threads 13 and 22 that the thick portion of the blocking means defined by the stop face 17 engages the recess 25 a little before the closure cap has been screwed home. When the cap is to be screwed off again from this closing position, its stop face 26 encounters the blocking face 17 of the blocking means 16 after short turning, which prevents additional turning of the cap. As long as the stiffening member 28 is firm on the sleeve member 24, it stiffens the thin-walled sleeve member 27 so that this member cannot be pressed inwards; but once the stiffening member has been torn off, the thin-walled sleeve member 27 can be pressed inwards by external pressure and thus be caused to press the blocking means 16 so much inwards against the cylindrical wall of the collar 12 as will make the blocking face 17 clear the stop face 26, and then the closure cap can be screwed off without any further obstacles.

Figure 2:
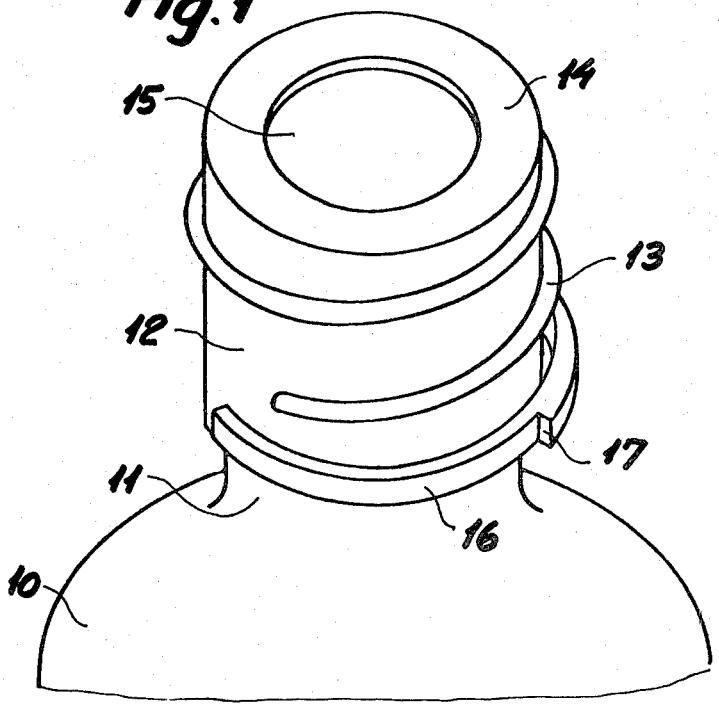
FIG. 2 is a cross-section of a part of another embodiment of the closure.
Figure 2:
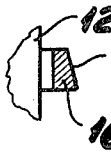

In the modified embodiment shown in FIG. 2 the blocking means 16 has a trapezoidal cross-section at least on the thick portion defined by the blocking face 17, and the trapezoidal cross-section is so disposed that the blocking means has an outwardly and upwardly inclined face 31 which forms a cam face which, when the closure cap is being applied, cooperates with the lower edge of the sleeve member 24 to temporarily press the blocking means inwards.

Figure 3:
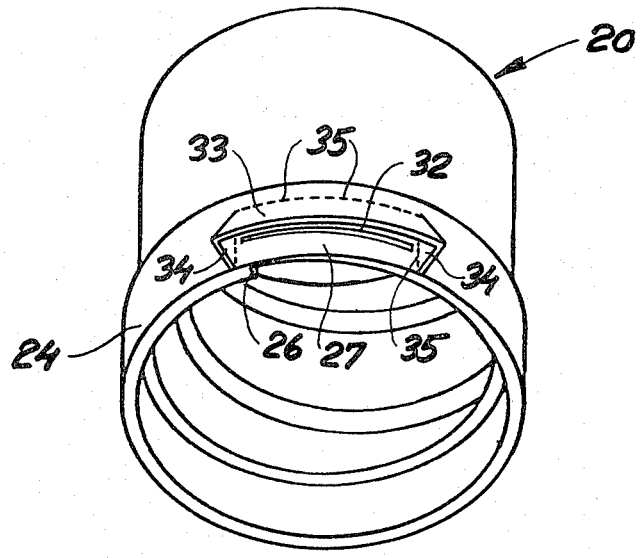
FIG. 3 is a perspective view of another embodiment of the closure cap.

The closure cap of FIG. 3 differs from the one shown in FIG. 1 in that the elastically resilient part 27 is defined at one side by a slit 32 extending along the lower edge of the sleeve member 24 and in that the stiffening member is formed by an awning-like projection with a roof portion 32 extending obliquely outwards and downwards from a line above and along the slit 32, and with two gable portions 34 disposed a small distance outside their respective ends of the elastically resilient part 27. The stiffening member 33, 34 has perforations 35 along the lines where it adjoins the sleeve wall and which thus form tear-off lines. Because of the slit 32, the elastically resilient part 27 is easier to press inwards to act on the blocking means 16 in the embodiment of FIG. 3 than in the one shown in FIG. 1. As the stiffening member 33, 34 is formed so as not to be connected with the elastically resilient part 27 anywhere, there is no risk of the resilient member being torn off together with the stiffening member.

The shown and described constructions can be modified inmany ways. For example, two or more angularly spaced blocking faces may be provided on the same or their respective blocking means, and these blocking faces may cooperate with the same or their respective stop faces. The part cooperating with the closure cap need not be an applied collar, but may be an integral component of the bottle because the entire bottle may consist of an elastic plastics material. Moreover, the blocking means might optionally extend all around the collar or the bottle neck. The recess in the closue cap may also have other shapes than the shown one and does not have to be disposed right down at the lower edge of the closure cap. Nor does the closure cap have to be a screw cap because the threads in the cap and on the collar or the neck may be replaced by bayonet locking means.

I claim:

1. A safety closure for a container serving as a receptacle for sensitive products, e.g. medicine, said closure comprising a closure cap and a container neck part, said closure cap being applied on and removed from the container neck part by rotation, said container neck part having an elastically resilient blocking means which a stop face on the closure cap encounters upon rotation of the closure cap in the direction of removal from the closing position when the blocking means is in an unaffected position, said closure cap having an elastically resilient part through which the blocking means can be actuated to cancel the blocking by external pressure on the part in question, characterized in that the blocking means is an elastic, flexible strip which extends along a portion of the periphery of the neck member and at some distance from the neck member and is attached to or connected with the neck member at the ends, and which is formed with a blocking face spaced somewhat from the ends and intended for cooperation with the stop face of the closure cap.

2. A safety closure according to claim 1, characterized by a substantially wedge-shaped recess which is formed along a section of the lower edge of the closure cap and has a truncated end face forming the said stop face, said recess defining a thin-walled area of the closure cap which forms the elastically resilient part.

3. A safety closure according to claim 1, characterized in that the elastically resilient part is defined at one side by the lower edge of the closure cap and at the other by a slit extending along said lower edge.

4. A safety closure according to claim 1, characterized in that the exterior of the closure cap is formed with a stiffening member which can be torn off and forms a bridge across the elastically resilient part.

5. A safety closure according to claim 4, characterized in that the stiffening member is sheet-shaped and disposed substantially in a radial plane.

6. A safety closure according to claim 4, characterized in that the stiffening member forms an awning-like projection which has gable portions and encloses the elastically resilient member on three sides.

7. A safety closure according to claim 1, characterized in that the elastic, flexible strip, at least in an area adjacent or at the side of the blocking face where the cross-section is biggest, has a substantially trapezoidal cross-section with an outwardly and upwardly inclined edge.

* * * * *